US006243921B1

(12) United States Patent
Chang

(10) Patent No.: US 6,243,921 B1
(45) Date of Patent: Jun. 12, 2001

(54) CLIP ASSEMBLY FOR A PACIFIER

(76) Inventor: Kuo Pin Chang, P.O. Box 82-144, Taipei (TW)

( * ) Notice: Subject to any disclaimer, the term of this patent is extended or adjusted under 35 U.S.C. 154(b) by 0 days.

(21) Appl. No.: 09/450,418

(22) Filed: Nov. 30, 1999

(51) Int. Cl.[7] ..... A61J 17/00
(52) U.S. Cl. ..... 24/3.13; 242/371; 242/385.4
(58) Field of Search ..... 242/376, 384.7, 242/385.4, 396.9, 396, 306, 371, 379.2, 379, 296, 185, 381, 385, 596, 206, 381.6, 396.6; 24/3–13; 224/162; 248/104; D24/194–196; 119/796

(56) References Cited

U.S. PATENT DOCUMENTS

D. 225,039 * 10/1972 Sauritis .
1,831,666 * 11/1931 Jacobia .
5,794,357 * 8/1998 Gilliam et al. .

FOREIGN PATENT DOCUMENTS

68922/94 * 3/1995 (AU) .

* cited by examiner

*Primary Examiner*—James R. Brittain
(74) *Attorney, Agent, or Firm*—A & J

(57) ABSTRACT

A clip assembly for a pacifier includes a fastener, a cover having one side fixedly engaged with the fastener and another side provided with a resilient projection, a circular container having radial outlet and an axle at a central portion thereof, a reel fitted within the circular container and having a center hole receiving the axle, the reel having a circular recess provided with a plurality of radial teeth on an inner circumference thereof and two positioning members adjacent to the radial teeth, a spiral spring fitted within the circular recess of the reel and having an inner end fixedly secured to the axle and an outer end fixedly connected to the positioning members, a circular plate mounted in the circular recess to prevent the spiral spring from getting out of the circular recess, a cord having an end fixedly secured to the circumferential groove, and a retainer fixedly connected to another end of the cord and having a fastening member and a linking chain having a plurality of ball-shaped elements engageable with the fastening member, whereby it is only necessary to pull the pacifier and push the switch to keep the cord at a fixed position when a child wants to suck the pacifier, and open the switch to release the cord to enable the spiral spring to rewind the cord and pull back the pacifier when the child spits out the pacifier, thereby preventing the pacifier from being made dirty.

1 Claim, 6 Drawing Sheets

CLIP ASSEMBLY FOR A PACIFIER

BACKGROUND OF THE INVENTION

1. Field of the Invention

This invention is related to a clip assembly for a pacifier and in particular to one which will rewind automatically when spat out by a child.

2. Description of the Prior Art

The pacifier is a rubber object that one gives a baby to suck so that it does not cry. However, the pacifier will be made dirty and get infected easily when spat out to the floor by a child thereby often causing damage to the health of the child. Hence, it has been proposed to use a clip B (see FIG. 1) to tie a pacifier A so as to prevent it from contacting the floor when the pacifier is spat out by a child. As shown in FIG. 1, the clip B includes a fastener B1 for securing to the clothes of a child, a link B2 having an end connected with the fastener B1, and a retainer ring B21 connected with another end of the link B2 and a loop member A1 of a pacifier A. However, such a clip cannot prevent the pacifier from contacting the floor when the child is crawling on the floor. In addition, the pacifier may cause hindrance for the child to crawl on the floor.

Therefore, it is an object of the present invention to provide a clip assembly for a pacifier which can obviate the above-mentioned drawbacks.

SUMMARY OF THE INVENTION

This invention is related to a clip assembly for a pacifier.

It is the primary object of the present invention to provide a clip assembly for a pacifier which will rewind automatically when spat out by a child.

It is another object of the present invention to provide a clip assembly for a pacifier which can effectively prevent the pacifier from being made dirty.

According to a preferred embodiment of the present invention, a clip assembly for a pacifier includes a fastener, a cover having one side fixedly engaged with the fastener and another side provided with a resilient projection, a circular container having radial outlet and an axle at a central portion thereof, a reel fitted within the circular container and having a center hole receiving the axle, the reel having a circular recess provided with a plurality of radial teeth on an inner circumference thereof and two positioning members adjacent to the radial teeth, a spiral spring fitted within the circular recess of the reel and having an inner end fixedly secured to the axle and an outer end fixedly connected to the positioning members, a circular plate mounted in the circular recess to prevent the spiral spring from getting out of the circular recess, a cord having an end fixedly secured to the circumferential groove, and a retainer fixedly connected to another end of the cord and having a fastening member and a linking chain having a plurality of ball-shaped elements engageable with the fastening member, whereby it is only necessary to pull the pacifier and push the switch to keep the cord at a fixed position when a child wants to suck the pacifier, and open the switch to release the cord to enable the spiral spring to rewind the cord and pull back the pacifier when the child spits out the pacifier, thereby preventing the pacifier from being made dirty.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
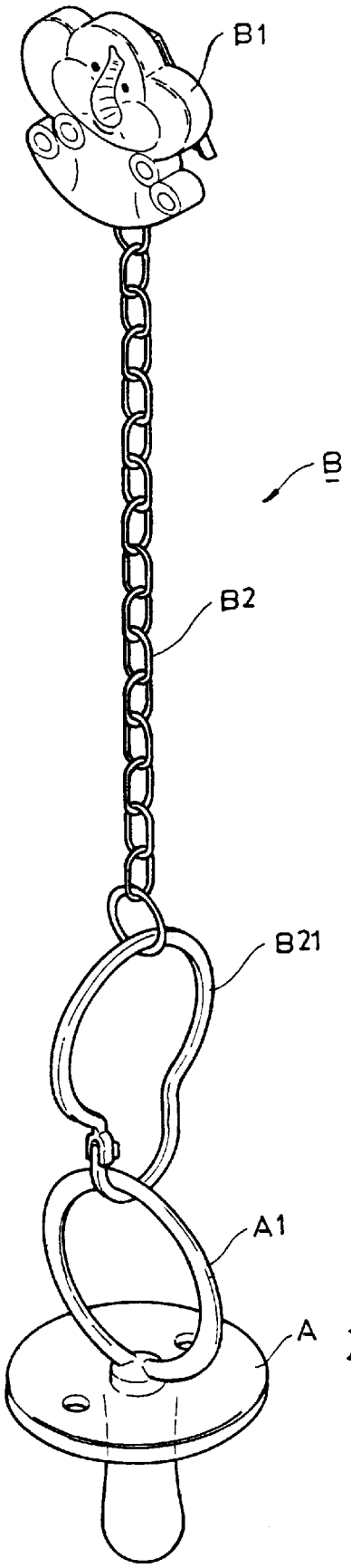
PRIOR ART FIG. 1
FIG. 1 illustrates a prior art clip for a pacifier.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
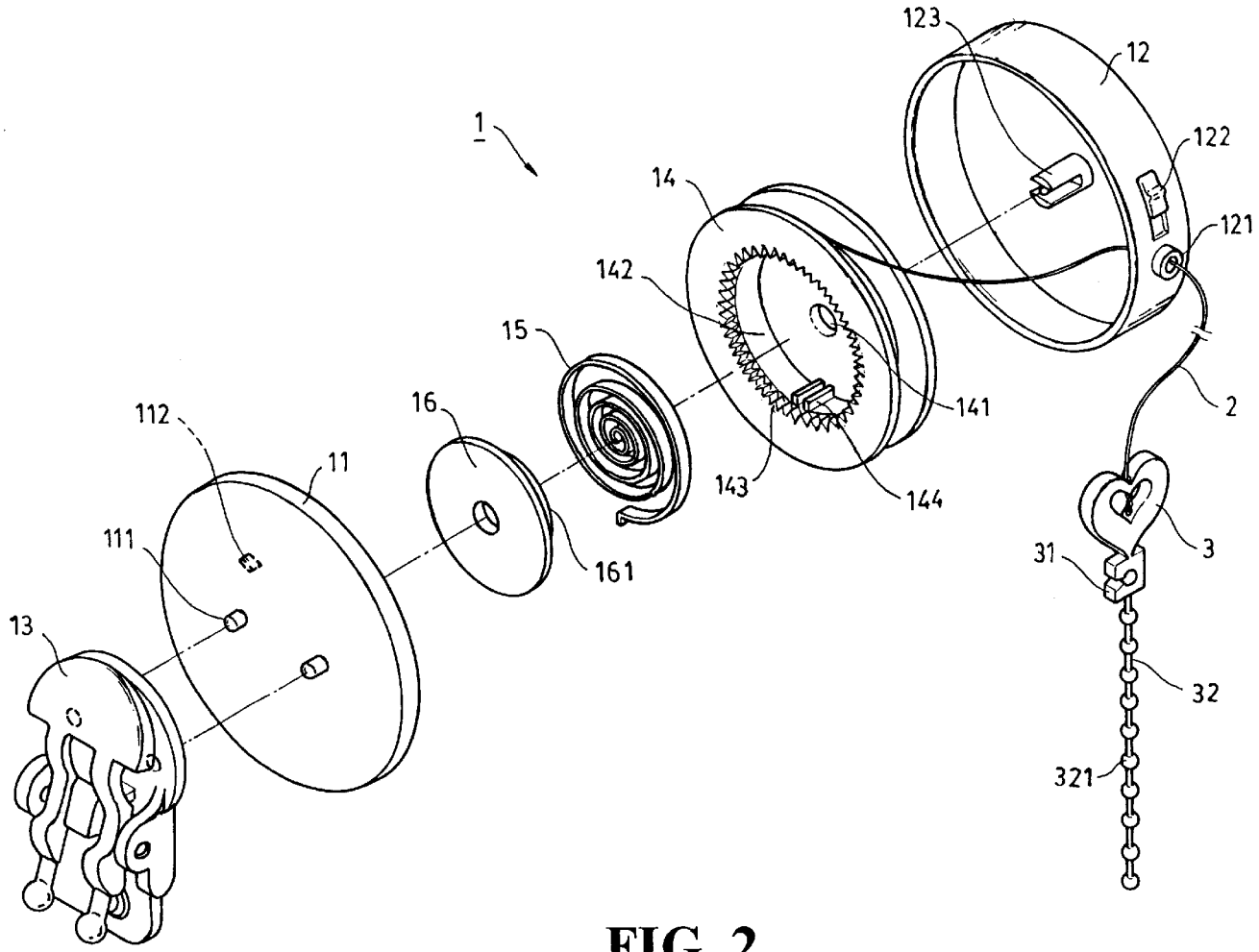
FIG. 2 is an exploded view of the present invention.
Figure 3:
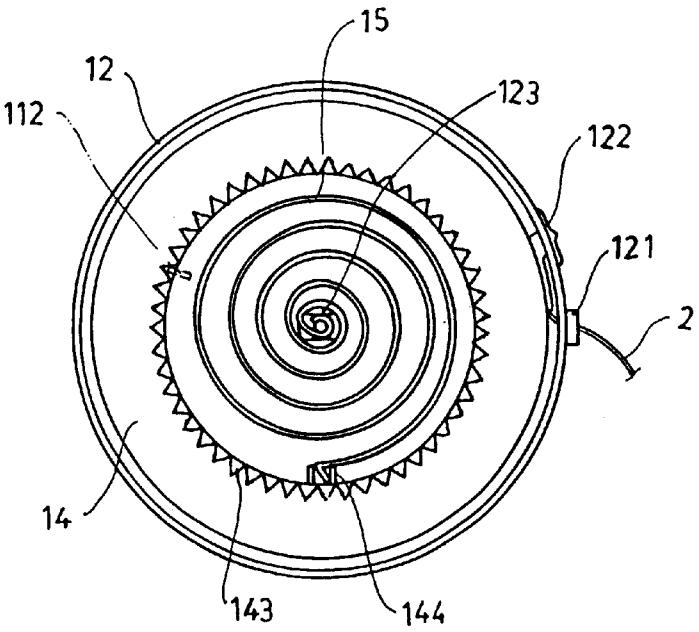
FIG. 3 is a sectional view of the present invention.

With reference to the drawings and in particular to FIGS. 2 and 3 thereof, the clip assembly 1 according to the present invention generally comprises a cover 11, a circular container 12, a fastener 13, a reel 14, a spiral spring 15 and a circular plate 16. The cover 11 is engaged with the circular container 12 and provided with two protuberances 111 at the outer side thereof adapted to engage with the fastener 13. The inner side of the cover 11 is formed with a resilient projection 112 adapted to engage with internal teeth 143 of the reel 14 for slowing down the rotation of the reel 14. The circular container 12 has a radial outlet 121 for the passage of a cord 2 and a switch 122 slidably mounted thereon and configured to close the outlet 121 so as to keep the cord 2 at a fixed position as desired. The central portion of the circular container 12 has an axle 123 extending through a center hole 141 of the reel 14. The axle 123 has a slot engaged with an end of the spiral spring 15. The reel 14 is formed with a circumferential groove for winding the cord 2. One side of the reel 14 has a recess 142 for receiving the spiral spring 15. The recess 142 is formed with a plurality of teeth 143 on its inner circumferential surface engaged with the resilient projection 112 of the cover 11. The inner circumferential surface of the recess 142 has a pair of positioning members 144 for fastening the other end of the spiral spring 15. When the reel 14 is rotated, the spiral spring 15 will be tightened. The circular plate 16 is arranged on the spiral spring 15 for preventing it from getting out of the reel 14 and has a center hole 161 for the passage of the axle 123. The cord 2 has an end fixedly secured to the circumferential groove of the reel

14 and another end extending through the radial outlet 121 to engage with a retainer 3. As the cord 2 is pulled, the reel 14 will be rotated to tighten the spiral spring 15. When the cord 2 is released, the spiral spring 15 will rotate the reel 14 in a reverse direction thereby rewinding the cord 2 on the circumferential groove of the reel 14 therefore pulling back the pacifier 4 (see FIG. 5). The retainer 3 is provided with a fastening member 31 at the lower end and a lining chain 32 having a plurality of ball-shaped elements 321. The ling chain 32 extends through a ring member 41 of the pacifier 4 and then engages with the fastening member 31.

Figure 4:
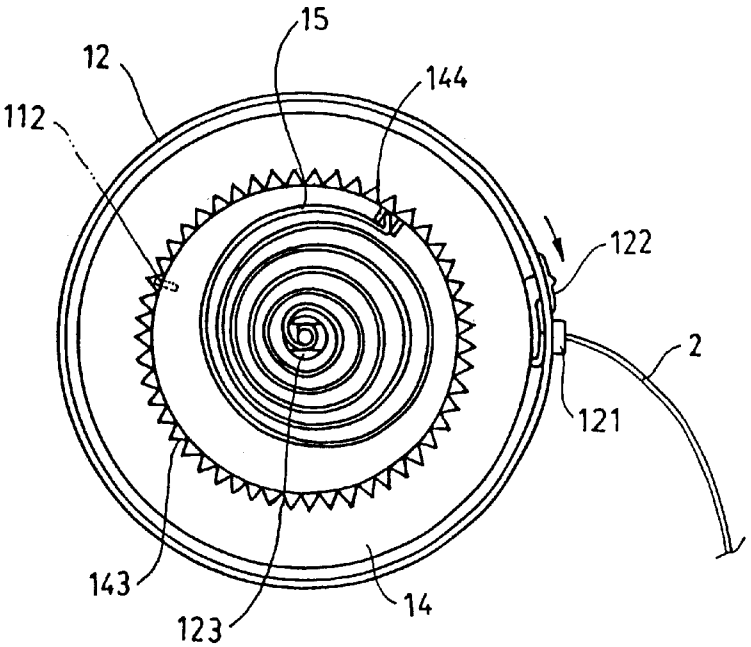
FIG. 4 illustrates the working principle of the present invention.
Figure 5:
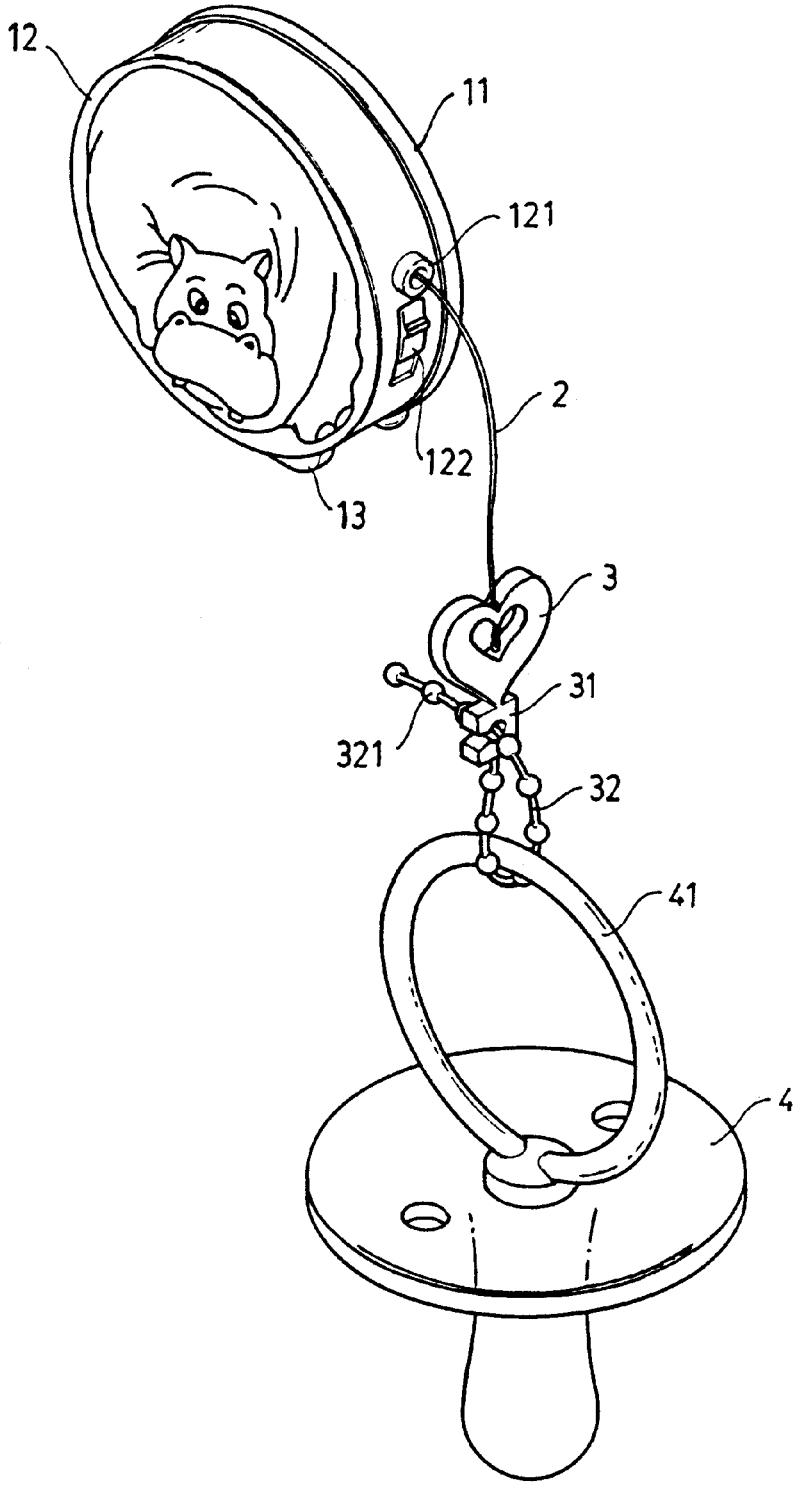
FIG. 5 is a working view of the present invention.

Referring to FIGS. 3, 4 and 5, when the child wants to suck the pacifier 3, it is only necessary to pull the pacifier 3 and then push the switch 122 to keep the cord 2 at a fixed position. When the child spits the pacifier 3 out, simply push open the switch 122 to release the cord 2 thereby enabling the spiral spring 15 to rewind the cord 2 and pulling back the pacifier 3. As the teeth 143 of the reel 14 are in contact with the resilient projection 112 of the cover 11 when the reel 14 is rotated, the speed of the reel 14 will be slowed down thus preventing the child from any possible danger. Accordingly, the pacifier 3 will be automatically withdrawn when not in use so that the pacifier 3 will not be made dirty and block the crawling of the child.

Figure 6:
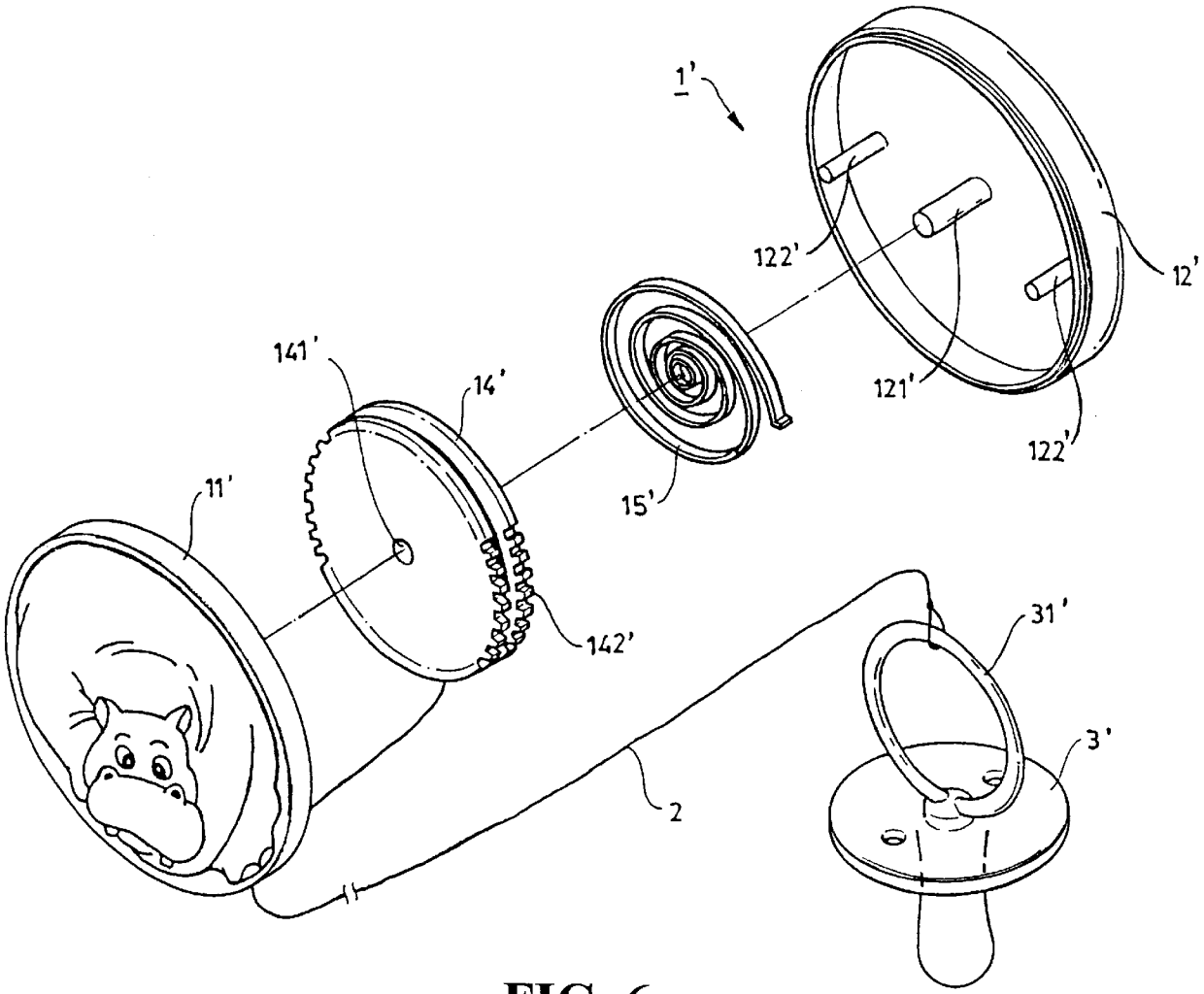
FIG. 6 is an exploded view of a second preferred embodiment according to the present invention.
Figure 8:
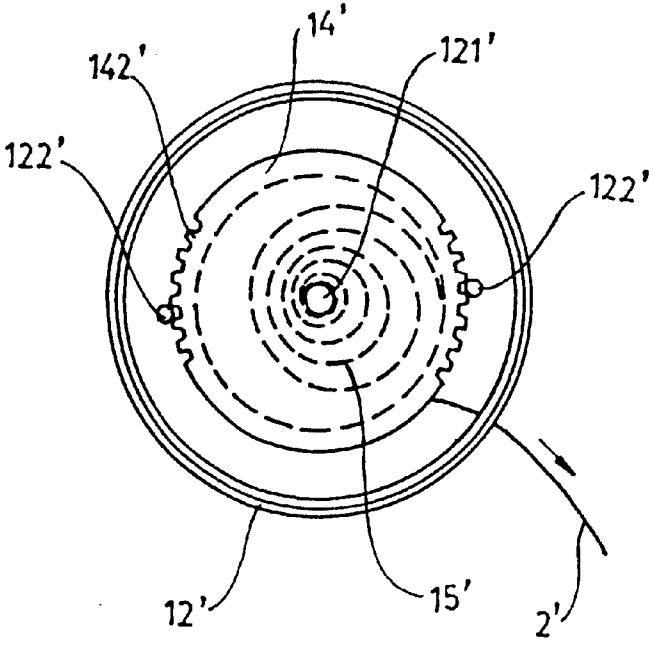
FIG. 8 illustrates the working principle of the second preferred embodiment.
Figure 7:
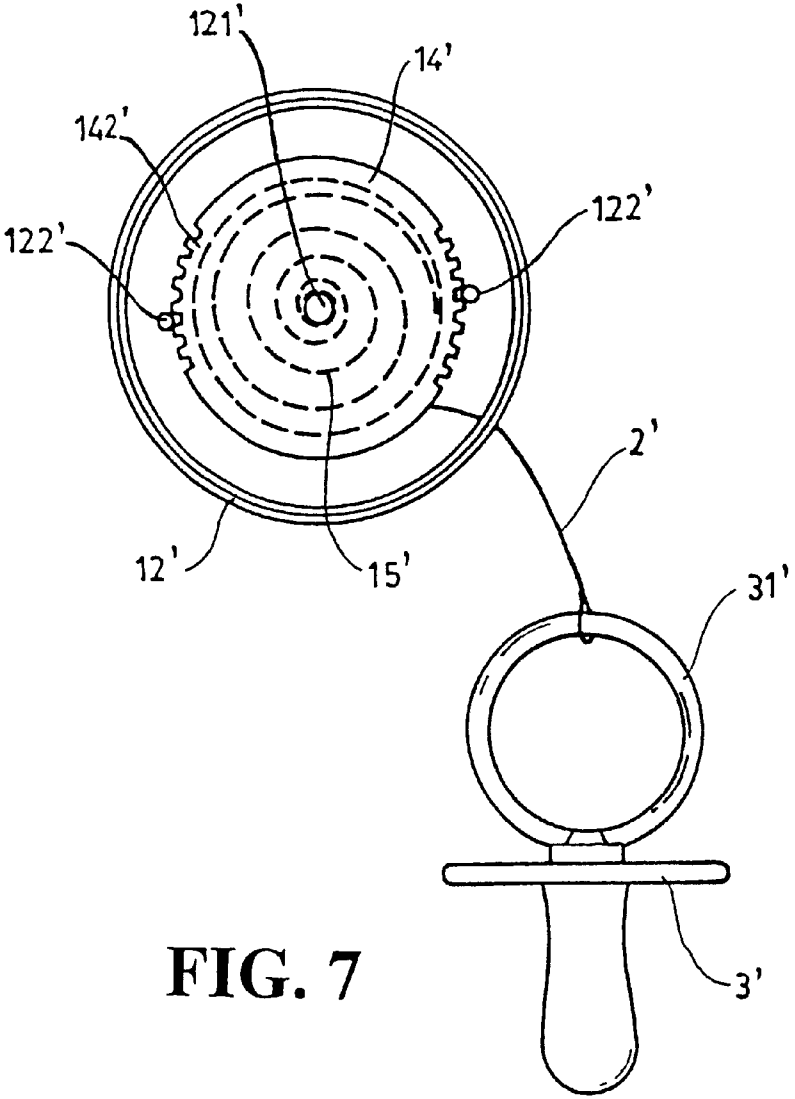
FIG. 7 is a sectional view of the second preferred embodiment.

FIGS. 6, 7 and 8 illustrate a second preferred embodiment of the present invention, which does not need a link to connect with a pacifier. As shown, the clip assembly 1' according to the second preferred embodiment generally comprises a circular container 12', a cover 11', a reel 14' and a spiral spring 15'. The cover 11' is provided with cartoon picture or the like at the outer side thereof. The circular container 12' is provided with a clamping means (not shown) at the outer side thereof for fastening the clip assembly to the clothes of a child. At the center of the circular container 12' there is an axle 121' extending through the center of the spiral spring 15' and a center hole 141'of the reel 14'. Two resilient pins 122' are provided at two sides of the axle 121' and arranged in contact with the teeth 142' of the reel 14' for slowing down the rotation speed of the reel 14'. The reel 14' is formed with a circumferential groove for receiving a cord 2'. The spiral spring 15 is connected at the outer end with an outer side of the reel 14' and at the inner end with the axle 121' of the circular container 12'. The cord 2' extends through an opening of the cover 11' to connect with a ring member 31' of the pacifier 3'.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A clip assembly for a pacifier comprising:

a fastener;

a cover having one side fixedly engaged with said fastener and another side provided with a resilient projection;

a circular container having a radial outlet and an axle at a central portion thereof;

a switch slidably mounted on said circular container and configured to close said radial outlet as desired;

a reel fitted within said circular container and having a center hole receiving said axle, said reel having a circular recess provided with a plurality of radial teeth on an inner circumference thereof and two positioning members adjacent to said radial teeth;

a spiral spring fitted within said circular recess of said reel and having an inner end fixedly secured to said axle and an outer end fixedly connected to said positioning members;

a circular plate mounted in said circular recess to prevent said spiral spring from getting out of said circular recess;

a cord having an end fixedly secured to said circumferential groove; and a retainer fixedly connected to another end of said cord and having a fastening member and a linking chain having a plurality of ball-shaped elements engageable with said fastening member;

whereby it is only necessary to pull said pacifier and push said switch to keep said cord at a fixed position when a child wants to suck said pacifier, and open said switch to release said cord to enable said spiral spring to rewind said cord and pull back said pacifier when the child spits out said pacifier, thereby preventing said pacifier from being made dirty.

* * * * *